US011521531B2

(12) United States Patent
Kim et al.

(10) Patent No.: US 11,521,531 B2
(45) Date of Patent: Dec. 6, 2022

(54) DISPLAY DEVICE PERFORMING STILL IMAGE DETECTION, AND METHOD OF DETECTING A STILL IMAGE IN A DISPLAY DEVICE

(71) Applicant: SAMSUNG DISPLAY CO., LTD., Yongin-si (KR)

(72) Inventors: Hong Soo Kim, Hwaseong-si (KR); Jin Young Roh, Hwaseong-si (KR); Se Hyuk Park, Seongnam-si (KR); Hyo Jin Lee, Seongnam-si (KR); Jae Keun Lim, Suwon-si (KR); Jun Heyung Jung, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 102 days.

(21) Appl. No.: 16/950,004

(22) Filed: Nov. 17, 2020

(65) Prior Publication Data

US 2021/0327323 A1 Oct. 21, 2021

(30) Foreign Application Priority Data

Apr. 16, 2020 (KR) ..... 10-2020-0045754

(51) Int. Cl.
*G09G 3/20* (2006.01)

(52) U.S. Cl.
CPC ..... *G09G 3/20* (2013.01); *G09G 2310/0267* (2013.01); *G09G 2310/0275* (2013.01); *G09G 2310/0286* (2013.01); *G09G 2310/04* (2013.01); *G09G 2320/103* (2013.01); *G09G 2320/106* (2013.01)

(58) Field of Classification Search
CPC ..... G09G 3/20; G09G 3/0267; G09G 3/3208; G09G 3/3611; G09G 3/3275; G09G 2310/0275; G09G 2310/0286; G09G 2310/04; G09G 2320/103; G09G 2320/106; G09G 2320/0247; G09G 2330/021; G09G 2340/0435; G09G 2360/16; H04N 5/144
See application file for complete search history.

(56) References Cited

U.S. PATENT DOCUMENTS

2015/0206467 A1* 7/2015 Choi ..... G09G 5/003 345/55
2016/0111055 A1* 4/2016 Na ..... G09G 3/3666 345/94

FOREIGN PATENT DOCUMENTS

| | | |
|---|---|---|
| JP | 2001-144968 | 5/2001 |
| KR | 1020150049895 | 5/2015 |
| KR | 1020170037783 | 4/2017 |

* cited by examiner

*Primary Examiner* — Alexander Eisen
*Assistant Examiner* — Kebede T Teshome
(74) *Attorney, Agent, or Firm* — F. Chau & Associates, LLC

(57) ABSTRACT

A display device includes a display panel including a plurality of pixels, and a panel driver including N registers, where N is an integer greater than 1. The panel driver is configured to divide the display panel into N first detection regions, to perform a first still image detection operation on each of the N first detection regions by using the N registers, to divide the display panel into N second detection regions different from the N first detection regions by using a result of the first still image detection operation, and to perform a second still image detection operation on each of the N second detection regions by using the N registers.

20 Claims, 11 Drawing Sheets

FIG. 7

| GRAY LEVEL | FLICKER VALUE | FREQUENCY(Hz) |
|---|---|---|
| 0-3 | 0 | 1 |
| 4-7 | 0 | 1 |
| 8-11 | 40 | 2 |
| 12-15 | 80 | 5 |
| 16-19 | 120 | 10 |
| 20-23 | 160 | 30 |
| 24-27 | 200 | 60 |
| ⋮ | ⋮ | ⋮ |
| 236-239 | 0 | 1 |
| 240-243 | 0 | 1 |
| 244-247 | 0 | 1 |
| 248-251 | 0 | 1 |
| 252-255 | 0 | 1 |

DISPLAY DEVICE PERFORMING STILL IMAGE DETECTION, AND METHOD OF DETECTING A STILL IMAGE IN A DISPLAY DEVICE

CROSS-REFERENCE TO RELATED APPLICATION

This application claims priority under 35 U.S.C. § 119 to Korean Patent Application No. 10-2020-0045754, filed on Apr. 16, 2020 in the Korean Intellectual Property Office (KIPO), the disclosure of which is incorporated by reference herein in its entirety.

TECHNICAL FIELD

Exemplary embodiments of the inventive concept relate to a display device, and more particularly, to a display device performing still image detection and a method of detecting a still image in the display device.

Discussion of Related Art

Reduction of power consumption is desirable in a display device used in a portable device, such as a smartphone, a tablet computer, etc. To reduce the power consumption of display devices, a low frequency driving technique, which drives or refreshes a display panel at a frequency lower than a normal driving frequency by analyzing input image data, has been developed. However, in a conventional display device to which the low frequency driving technique is applied, when a still image is not displayed in an entire region of a display panel, or when the still image is displayed only in a partial region of the display panel, the entire region of the display panel may be driven at the normal driving frequency. Thus, in this case, the low frequency driving may not be performed, and power consumption may not be reduced.

Recently, to reduce the power consumption even in the case where the still image is displayed only in the partial region of the display panel, a multi-frequency driving (MFD) technique which drives a still image region and a moving image region of the display panel at different driving frequencies is being developed. To perform this multi-frequency driving, a display device may store image data of a previous frame period in a frame memory, and may compare image data of a current frame period with the image data stored in the frame memory to divide the display panel into the still image region and the moving image region. In other words, a conventional display device performing the multi-frequency driving technique requires the frame memory to detect the still image region in the partial region of the display panel.

SUMMARY

According to exemplary embodiments of the inventive concept, a display device includes a display panel including a plurality of pixels, and a panel driver including N registers, where N is an integer greater than 1. The panel driver divides the display panel into N first detection regions, performs a first still image detection operation on each of the N first detection regions by using the N registers, divides the display panel into N second detection regions different from the N first detection regions by using a result of the first still image detection operation, and performs a second still image detection operation on each of the N second detection regions by using the N registers.

In exemplary embodiments of the inventive concept, in first and second frame periods, the panel driver may equally divide input image data for the display panel into N first detection region image data for the N first detection regions having a same size.

In exemplary embodiments of the inventive concept, in the first frame period, the panel driver may calculate previous representative values for the N first detection region image data, and may store the previous representative values in the N registers. In the second frame period, the panel driver may calculate current representative values for the N first detection region image data, and may perform the first still image detection operation that determines whether each of the N first detection regions is a still image region or a moving image region by comparing the current representative values with the previous representative values stored in the N registers.

In exemplary embodiments of the inventive concept, each of the previous representative values and the current representative values may be a checksum value of a corresponding one of the N first detection region image data.

In exemplary embodiments of the inventive concept, each of the previous representative values and the current representative values may be an average value of a corresponding one of the N first detection region image data.

In exemplary embodiments of the inventive concept, each of the previous representative values and the current representative values may be a sum value of a corresponding one of the N first detection region image data.

In exemplary embodiments of the inventive concept, in third and fourth frame periods, the panel driver may set a still image region detected by the first still image detection operation as one of the N second detection regions, may set remaining N−1 detection regions of the N second detection regions having a same size by equally dividing a moving image region detected by the first still image detection operation, and may divide input image data for the display panel into N second detection region image data for the N second detection regions.

In exemplary embodiments of the inventive concept, in the third frame period, the panel driver may calculate previous representative values for the N second detection region image data, and may store the previous representative values in the N registers. In the fourth frame period, the panel driver may calculate current representative values for the N second detection region image data, and may perform the second still image detection operation that determines whether each of the N second detection regions is the still image region or the moving image region by comparing the current representative values with the previous representative values stored in the N registers.

In exemplary embodiments of the inventive concept, in a case where a still image region detected by the first still image detection operation and a still image region detected by the second still image detection operation are different from each other, the panel driver may set the still image region detected by the second still image detection operation as one detection region of N third detection regions, may set remaining N−1 detection regions of the N third detection regions having a same size by equally dividing a moving image region detected by the second still image detection operation, and may perform a third still image detection operation on each of the N third detection regions by using the N registers.

In exemplary embodiments of the inventive concept, in a case where a still image region detected by the first still image detection operation and a still image region detected by the second still image detection operation are substantially the same as each other, the panel driver may increase the still image region detected by the second still image detection operation by M pixels in a first direction, where M is an integer greater than 0, may set the still image region detected by the second still image operation increased by the M pixels as one detection region of N third detection regions, may decrease a moving image region detected by the second still image detection operation by the M pixels in the first direction, may set remaining N−1 detection regions of the N third detection regions having a same size by equally dividing the moving image region decreased by the M pixels, and may perform a third still image detection operation on each of the N third detection regions by using the N registers.

In exemplary embodiments of the inventive concept, in a case where a still image region is detected by the third still image detection operation, the panel driver may further increase the still image region detected by the third still image detection operation by the M pixels in the first direction, may set the still image region detected by the third still image detection operation further increased by the M pixels as one detection region of N fourth detection regions, may further decrease a moving image region detected by the third still image detection operation by the M pixels in the first direction, may set remaining N−1 detection regions of the fourth detection regions having a same size by equally dividing the moving image region detected by the third still image detection operation further decreased by the M pixels, and may perform a fourth still image detection operation on each of the N fourth detection regions by using the N registers.

In exemplary embodiments of the inventive concept, in a case where all of the third detection regions are determined as a moving image region, the panel driver may set the N second detection regions used in the second still image detection operation as N fourth detection regions, and may perform a fourth still image detection operation on each of the N fourth detection regions by using the N registers.

In exemplary embodiments of the inventive concept, the panel driver may continuously use the N fourth detection regions until a still image region detected by the fourth still image detection operation is changed, and may reset the N fourth detection regions when the still image region detected by the fourth still image detection operation is changed.

In exemplary embodiments of the inventive concept, the panel driver may drive a moving image region detected by the fourth still image detection at a first driving frequency, and may drive a still image region detected by the fourth still image detection operation at a second driving frequency lower than the first driving frequency.

According to exemplary embodiments of the inventive concept, in a method of detecting a still image in a display device including N registers, where N is an integer greater than 1, a display panel of the display device is divided into N first detection regions, a first still image detection operation is performed on each of the N first detection regions by using the N registers, the display panel is divided into N second detection regions different from the N first detection regions by using a result of the first still image detection operation, and a second still image detection operation is performed on each of the N second detection regions by using the N registers.

In exemplary embodiments of the inventive concept, to divide the display panel into the first detection regions, in first and second frame periods, input image data for the display panel may be equally divided into N first detection region image data for the N first detection regions having a same size. To perform the first still image detection operation, previous representative values for the first detection region image data may be calculated in the first frame period, the previous representative values may be stored in the N registers in the first frame period, current representative values for the N first detection region image data may be calculated in the second frame period, and the first still image detection operation that determines whether each of the N first detection regions is a still image region or a moving image region may be performed by comparing the current representative values with the previous representative values stored in the N registers in the second frame period.

In exemplary embodiments of the inventive concept, to divide the display panel into the N second detection regions, a still image region detected by the first still image detection operation may be set as one of the N second detection regions in third and fourth frame periods, remaining N−1 detection regions of the N second detection regions having a same size may be set by equally dividing a moving image region detected by the first still image detection operation in the third and fourth frame periods, and input image data for the display panel may be divided into N second detection region image data for the N second detection regions. To perform the second still image detection operation, previous representative values for the second detection region image data may be calculated in the third frame period, the previous representative values may be stored in the N registers in the third frame period, current representative values for the N second detection region image data may be calculated in the fourth frame period, and the second still image detection operation that determines whether each of the N second detection regions is the still image region or the moving image region may be performed by comparing the current representative values with the previous representative values stored in the N registers in the fourth frame period.

In exemplary embodiments of the inventive concept, in a case where a still image region detected by the first still image detection operation and a still image region detected by the second still image detection operation are different from each other, the still image region detected by the second still image detection operation may be set as one of N third detection regions, remaining N−1 detection regions of the N third detection regions having a same size may be set by equally dividing a moving image region detected by the second still image detection operation, and a third still image detection operation may be performed on each of the N third detection regions by using the N registers.

In exemplary embodiments of the inventive concept, in a case where a still image region detected by the first still image detection operation and a still image region detected by the second still image detection operation are substantially the same as each other, the still image region detected by the second still image detection may be increased by M pixels in a first direction, where M is an integer greater than 0, the still image region detected by the second still image detection operation increased by the M pixels may be set as one of N third detection regions, a moving image region detected by the second still image detection operation may be decreased by the M pixels in the first direction, remaining N−1 detection regions of the N third detection regions having a same size may be set by equally dividing the moving image region decreased by the M pixels, and a third still image detection operation may be performed on each of the N third detection regions by using the N registers.

In exemplary embodiments of the inventive concept, in a case where all of the N third detection regions are determined as the moving image region, the N second detection regions used in the second still image detection operation may be set as N fourth detection regions, a fourth still image detection operation may be performed on each of the N fourth detection regions by using the N registers, and the N fourth detection regions may be reset when a still image region detected by the fourth still image detection operation is changed.

According to exemplary embodiments of the inventive concept, in a method of detecting a still image in a display device, a display panel of the display device is equally divided into N first detection regions, and input image data is equally divided into N first detection region image data, where N is an integer greater than 1, in first and second frame periods. Previous representative values of the N first detection region image data are stored in the first frame period. Current representative values of the N first detection region image data are calculated, and a first still image detection operation is performed to determine whether each of the N first detection regions is a still image region or a moving image region, by comparing the current representative values with the previous representative values, in the second frame period. At least two of the N first detection regions are set as one detection region of N second detection regions, and a remaining portion of the N first detection regions are equally divided into remaining N−1 detection regions of the N second detection regions, in third and fourth frame periods. A second still image detection operation is performed to determine whether each of the N second detection regions is a still image region or a moving image region, in the fourth frame period.

BRIEF DESCRIPTION OF THE DRAWINGS

The above and other features of the inventive concept will be more clearly understood by describing in detail exemplary embodiments thereof with reference to the accompanying drawings.

FIG. 7 is a diagram illustrating a flicker lookup table included in a display device according to exemplary embodiments of the inventive concept.

DETAILED DESCRIPTION OF THE EMBODIMENTS

Figure 1:
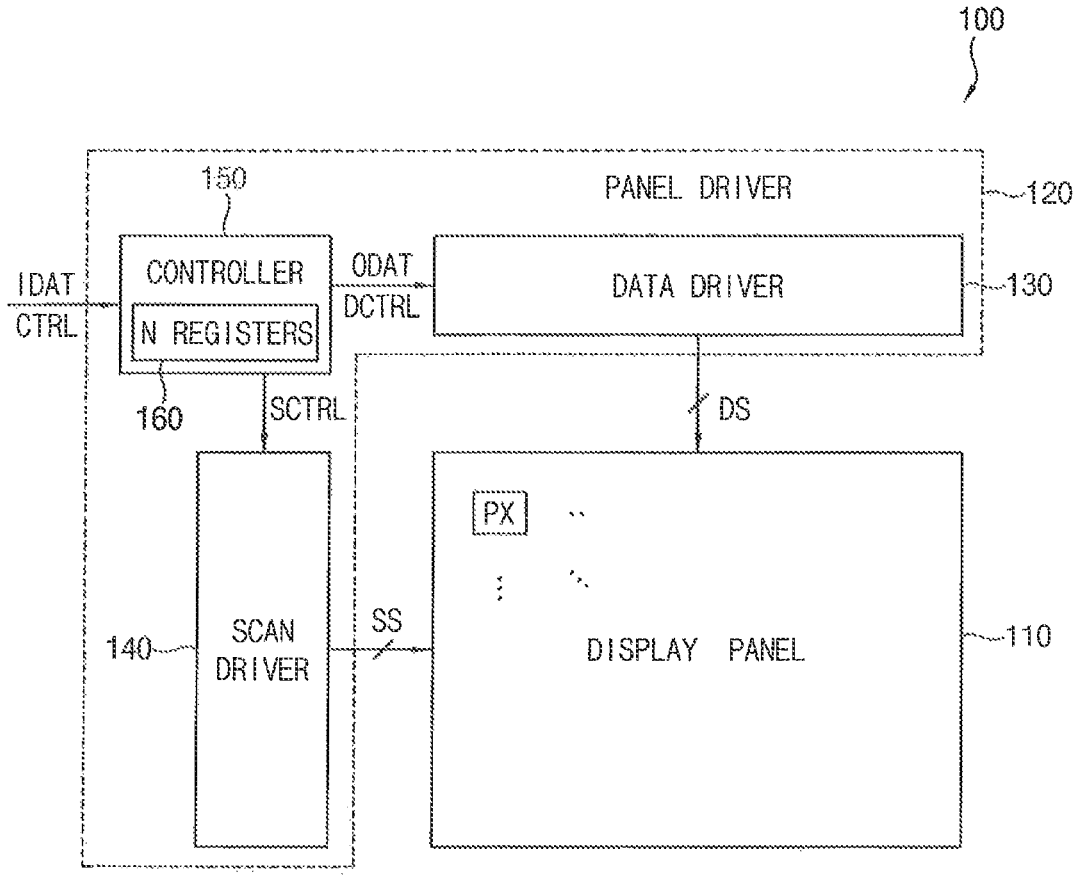
FIG. 1 is a block diagram illustrating a display device according to exemplary embodiments of the inventive concept.

Exemplary embodiments of the inventive concept provide a display device capable of efficiently performing a still image detection operation without using a frame memory.

Exemplary embodiments of the inventive concept also provide a method of detecting a still image in a display device capable of efficiently performing a still image detection operation without using a frame memory.

Hereinafter, exemplary embodiments of the inventive concept will be explained in detail with reference to the accompanying drawings. Like reference numerals may refer to like elements throughout this application.

Figure 2:
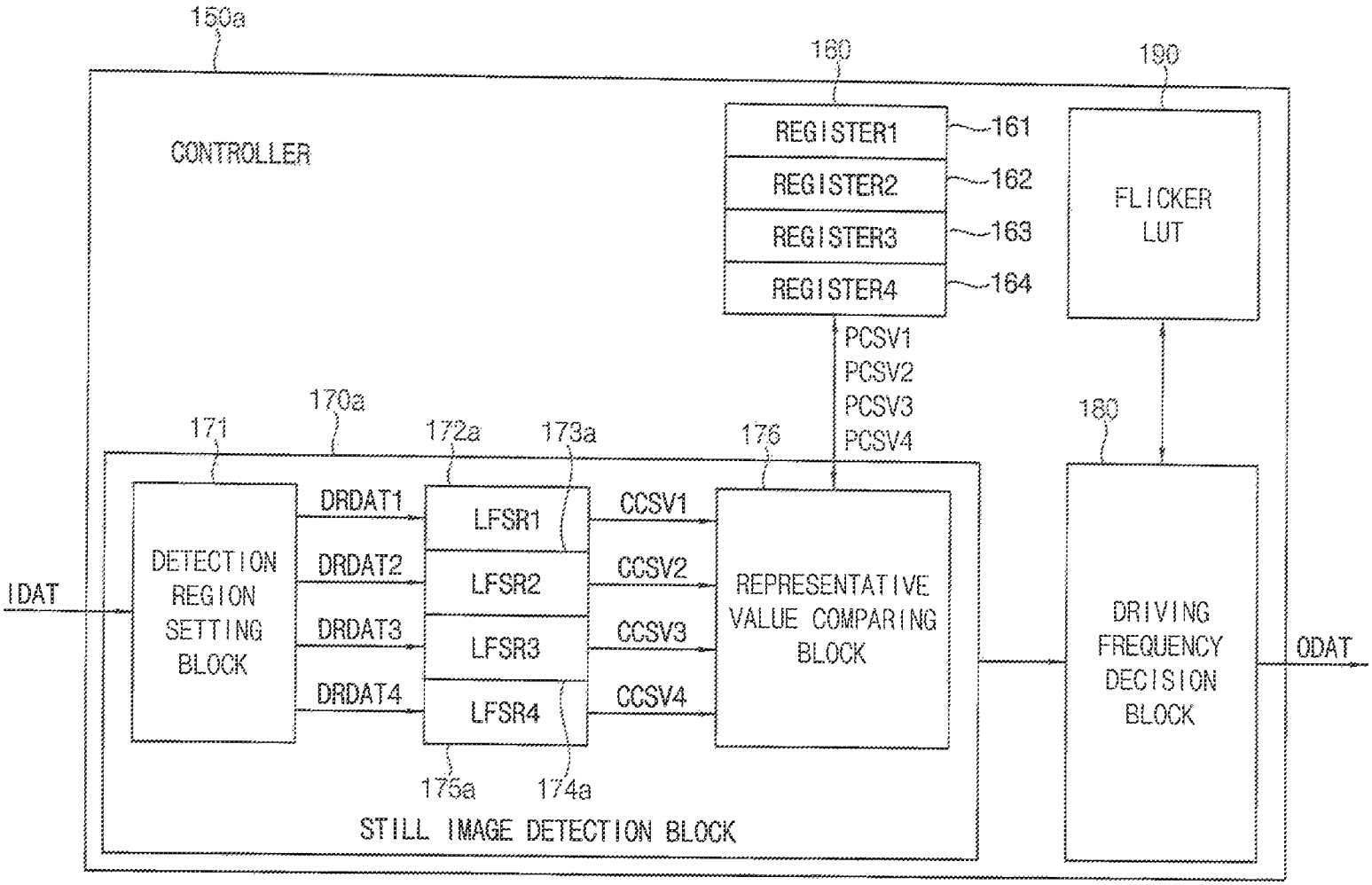
FIG. 2 is a block diagram illustrating a controller included in a display device according to exemplary embodiments of the inventive concept.
Figure 3:
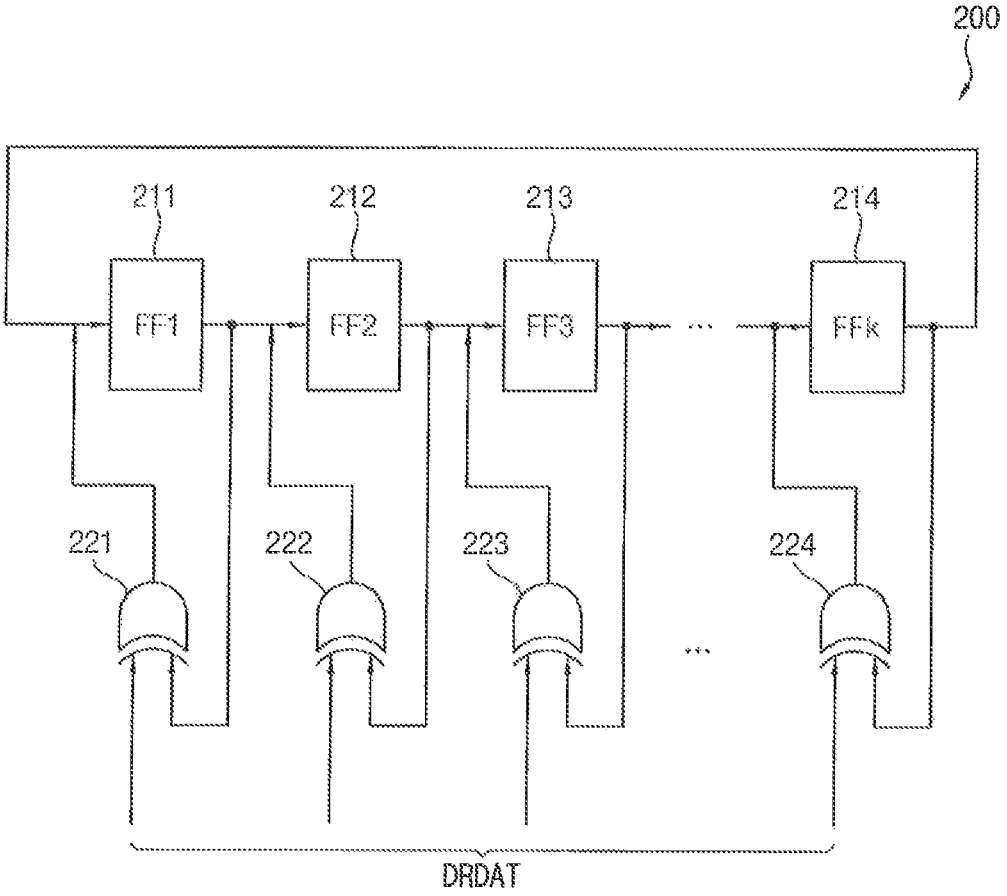
FIG. 3 is a block diagram illustrating a linear feedback shift register (LFSR) included in the controller of FIG. 2 according to exemplary embodiments of the inventive concept.
Figure 4:
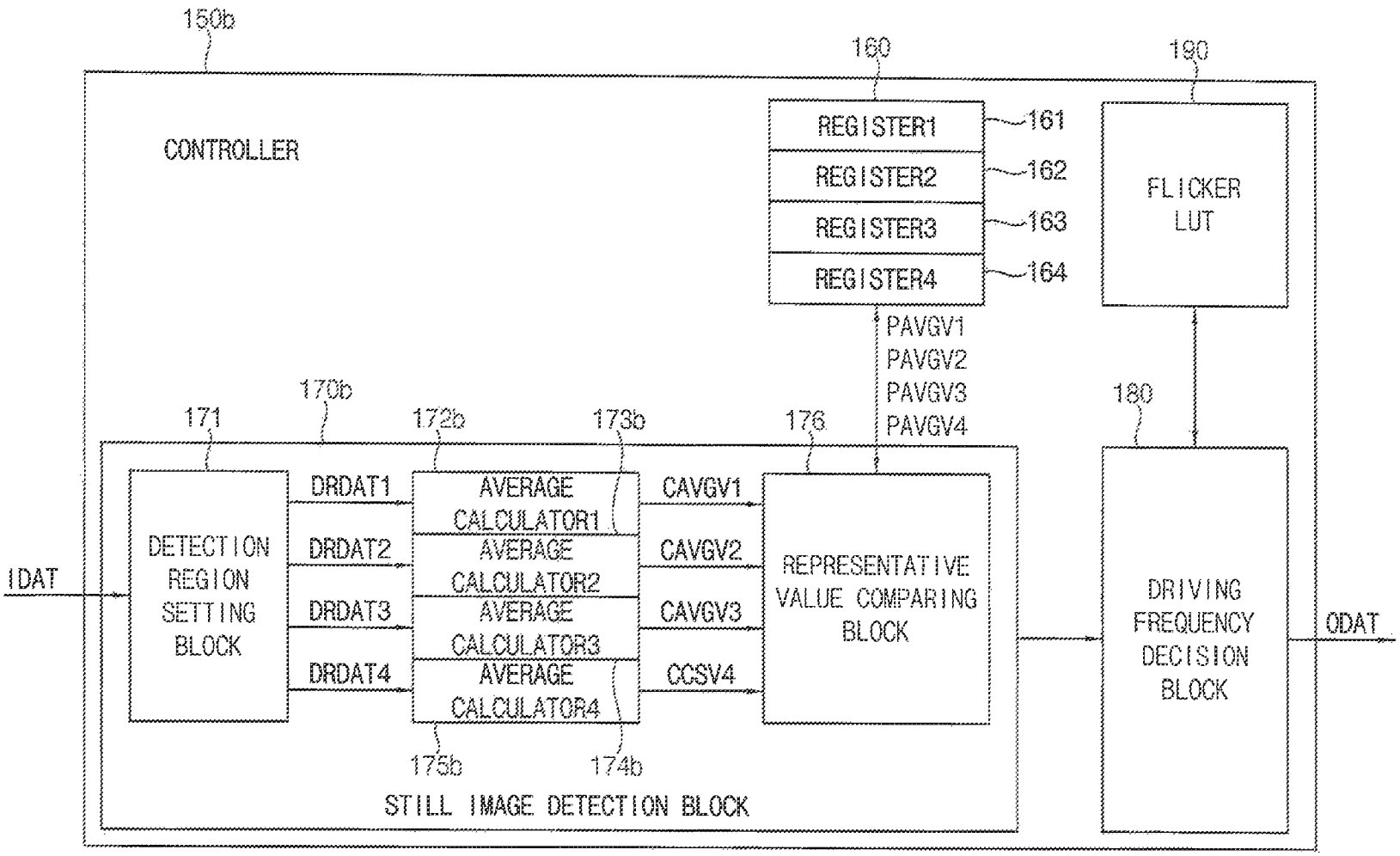
FIG. 4 is a block diagram illustrating a controller included in a display device according to exemplary embodiments of the inventive concept.
Figure 5:
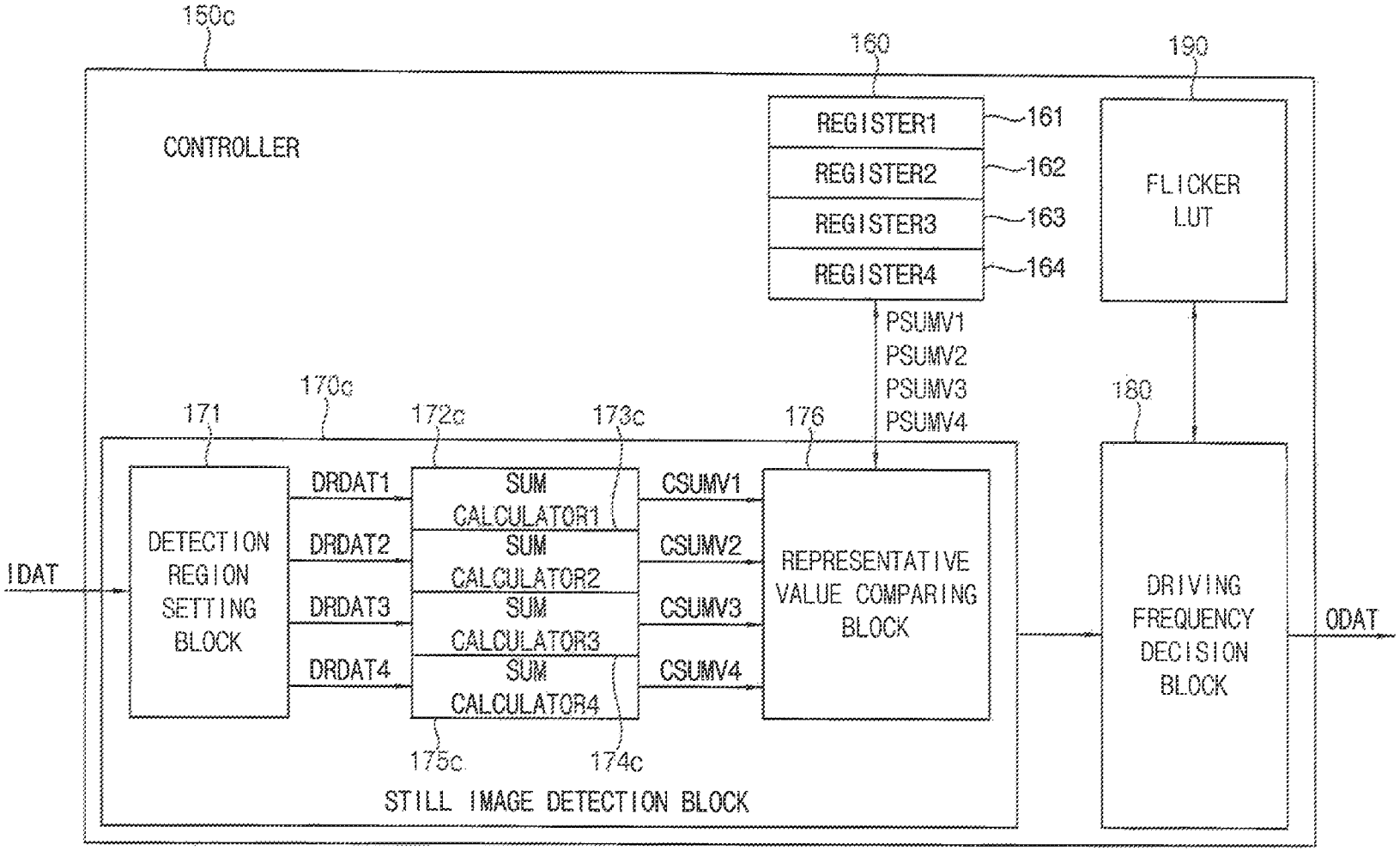
FIG. 5 is a block diagram illustrating a controller included in a display device according to exemplary embodiments of the inventive concept.
Figure 6:
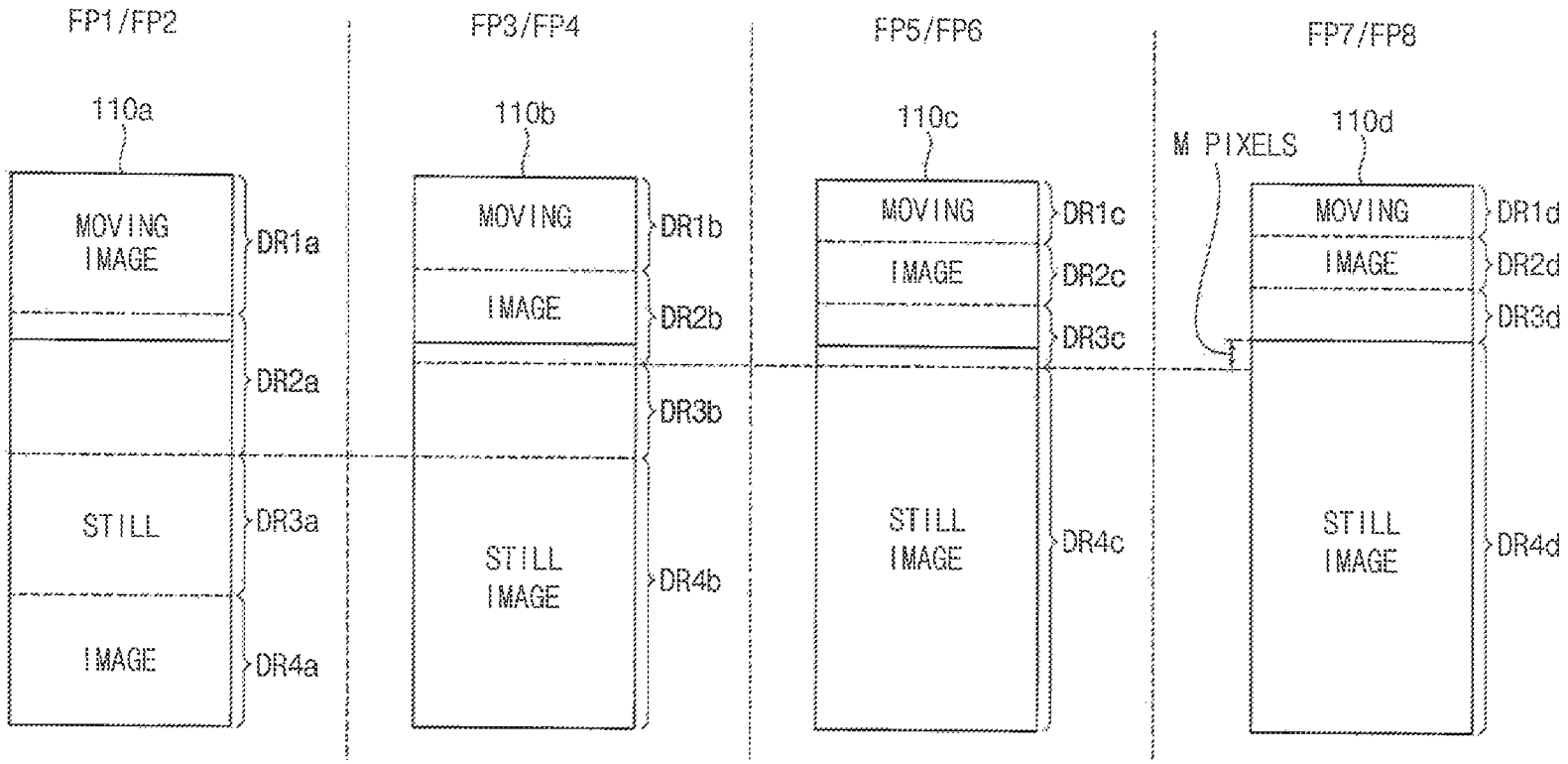
FIG. 6 is a diagram for describing an operation of a still image detection block included in a display device according to exemplary embodiments of the inventive concept.
Figure 8:
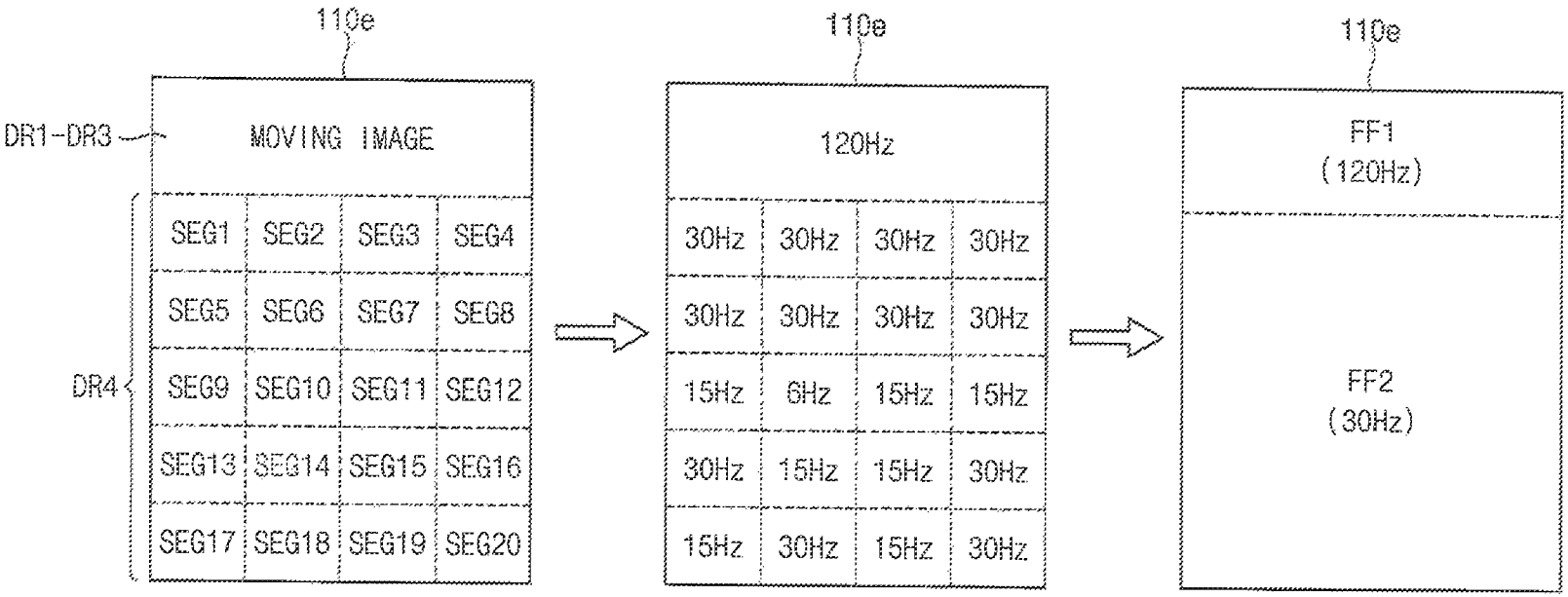
FIG. 8 is a diagram for describing an operation of a driving frequency decision block included in a display device according to exemplary embodiments of the inventive concept.
Figure 9:
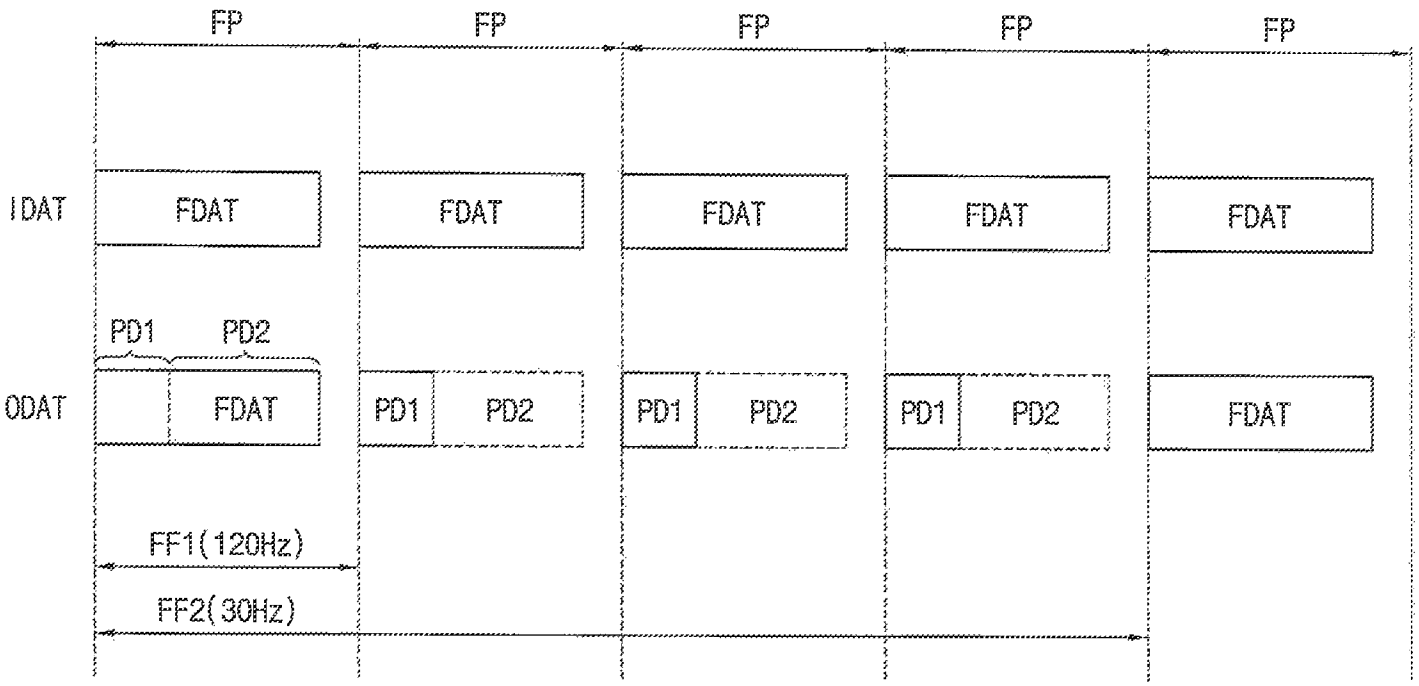
FIG. 9 is a diagram for describing an example where a display panel is driven in a display device according to exemplary embodiments of the inventive concept.

FIG. 1 is a block diagram illustrating a display device according to exemplary embodiments of the inventive concept. FIG. 2 is a block diagram illustrating a controller included in a display device according to exemplary embodiments of the inventive concept. FIG. 3 is a block diagram illustrating a linear feedback shift register (LFSR) included in the controller of FIG. 2. FIG. 4 is a block diagram illustrating a controller included in a display device according to exemplary embodiments of the inventive concept. FIG. 5 is a block diagram illustrating a controller included in a display device according to exemplary embodiments of the inventive concept. FIG. 6 is a diagram for describing an operation of a still image detection block included in a display device according to exemplary embodiments of the inventive concept. FIG. 7 is a diagram illustrating a flicker lookup table included in a display device according to exemplary embodiments of the inventive concept. FIG. 8 is a diagram for describing an operation of a driving frequency decision block included in a display device according to exemplary embodiments of the inventive concept. FIG. 9 is a diagram for describing an example where a display panel is driven in a display device according to exemplary embodiments of the inventive concept.

Referring to FIG. 1, a display device 100 according to exemplary embodiments of the inventive concept may include a display panel 110 including a plurality of pixels PX, and a panel driver 120 driving the display panel 110. In exemplary embodiments of the inventive concept, the panel driver 120 may include a data driver 130 providing data signals DS to the plurality of pixels PX, a scan driver 140 providing scan signals SS to the plurality of pixels PX, and a controller 150 controlling the data driver 130 and the scan driver 140.

The display panel 110 may include a plurality of data lines, a plurality of scan lines, and the plurality of pixels PX coupled to the plurality of data lines and the plurality of scan lines. In exemplary embodiments of the inventive concept, each pixel PX may include at least one capacitor, at least two transistors, and an organic light emitting diode (OLED), and the display panel 110 may be an OLED display panel. Further, in exemplary embodiments of the inventive concept, each pixel PX may be a hybrid oxide polycrystalline (HOP) pixel suitable for low frequency driving capable of reducing power consumption. For example, in the HOP pixel, at least one first transistor may be implemented with a low-temperature polycrystalline silicon (LTPS) PMOS transistor, and at least one second transistor may be implemented with an oxide NMOS transistor. In exemplary embodiments of the inventive concept, the display panel 110 may be a liquid crystal display (LCD) panel, or any other suitable display panel.

The data driver 130 may generate the data signals DS based on output image data ODAT and a data control signal DCTRL received from the controller 150, and may provide the data signals DS to the plurality of pixels PX through the plurality of data lines. In exemplary embodiments of the inventive concept, the data control signal DCTRL may include, but is not limited to, an output data enable signal, a horizontal start signal, and a load signal. In exemplary embodiments of the inventive concept, the data driver 130 and the controller 150 may be implemented with a single integrated circuit, and the integrated circuit may be referred to as a timing controller embedded data driver (TED). In exemplary embodiments of the inventive concept, the data driver 130 and the controller 150 may be implemented with separate integrated circuits.

The scan driver 140 may generate the scan signals SS based on a scan control signal SCTRL received from the controller 150, and may provide the scan signals SS to the plurality of pixels PX through the plurality of scan lines. In exemplary embodiments of the inventive concept, the scan driver 140 may sequentially provide the scan signals SS to the plurality of pixels PX on a row-by-row basis. Further, in exemplary embodiments of the inventive concept, the scan control signal SCTRL may include, but is not limited to, a scan start signal and a scan clock signal. In exemplary embodiments of the inventive concept, the scan driver 140 may be integrated or formed in a peripheral portion of the display panel 110. In exemplary embodiments of the inventive concept, the scan driver 140 may be implemented with one or more integrated circuits.

The controller 150 (e.g., a timing controller (TCON)) may receive input image data IDAT and a control signal CTRL from an external host processor (e.g., an application processor (AP), a graphic processing unit (GPU), or a graphic card). In exemplary embodiments of the inventive concept, the input image data IDAT may be, but is not limited to, RGB image data including red image data, green image data, and blue image data. In exemplary embodiments of the inventive concept, the control signal CTRL may include, but is not limited to, a vertical synchronization signal, a horizontal synchronization signal, an input data enable signal, a master clock signal, etc. The controller 150 may generate the output image data ODAT, the data control signal DCTRL, and the scan control signal SCTRL based on the input image data IDAT and the control signal CTRL. The controller 150 may control an operation of the data driver 130 by providing the output image data ODAT and the data control signal DCTRL to the data driver 130, and may control an operation of the scan driver 140 by providing the scan control signal SCTRL to the scan driver 140.

In the display device 100 according to exemplary embodiments of the inventive concept, the panel driver 120 may include N registers 160, and may efficiently perform a still image detection operation that divides the display panel 110 into a still image region and a moving image region by dynamically changing detection regions respectively corresponding to the N registers 160. Here, N may be an integer greater than 1, and may be less than or equal to the number of rows of the pixels PX of the display panel 110.

In exemplary embodiments of the inventive concept, the panel driver 120 may divide the display panel 110 into N first detection regions, and may perform a first still image detection operation on each of the first detection regions by using the N registers 160. Here, the division of the display panel 110 may be not a physical division of the display panel 110 but a logical division of the display panel 110, and may include dividing the input image data IDAT for the display panel 110 into detection region image data respectively for the detection regions. Further, the panel driver 120 may divide the display panel 110 into N second detection regions different from the first detection regions by using a result of the first still image detection operation, and may perform a second still image detection operation on each of the second detection regions by using the N registers 160. Accordingly, the display device 100 according to exemplary embodiments of the inventive concept may not use a frame memory, and may minutely detect the still image region by using the limited number of registers 160.

In exemplary embodiments of the inventive concept, as illustrated in FIG. 2, a controller 150*a* may include the N registers 160 (e.g., four registers 161, 162, 163, and 164), a still image detection block 170*a*, a driving frequency decision block 180, and a flicker lookup table (LUT) 190.

The still image detection block 170*a* may divide the display panel 110 into four detection regions respectively corresponding to the four registers 161, 162, 163, and 164, and may determine whether each of the four detection regions is a still image region or a moving image region. In exemplary embodiments of the inventive concept, the four registers 161, 162, 163, and 164 may store four previous representative values of four detection region image data DRDAT1, DRDAT2, DRDAT3, and DRDAT4 for the four detection regions in a previous frame period. The still image detection block 170*a* may calculate four current representative values of the four detection region image data DRDAT1, DRDAT2, DRDAT3, and DRDAT4 in a current frame period, and may perform a still image detection operation that determines whether each of the four detection regions is the still image region or the moving image region by comparing the four current representative values with the four previous representative values stored in the four registers 161, 162, 163, and 164.

In exemplary embodiments of the inventive concept, as illustrated in FIG. 2, the four previous representative values may be four previous checksum values PCSV1, PCSV2, PCSV3, and PCSV4, and the four current representative values may be four current checksum values CCSV1, CCSV2, CCSV3, and CCSV4. For example, to perform the still image detection operation by comparing the four current checksum values CCSV1, CCSV2, CCSV3, and CCSV4 with the four previous checksum values PCSV1, PCSV2, PCSV3, and PCSV4, as illustrated in FIG. 2, the still image detection block 170*a* may include a detection region setting block 171, N (e.g., four) linear feedback shift registers (LFSRs) 172*a*, 173*a*, 174*a*, and 175*a*, and a representative value comparing block 176.

The detection region setting block 171 may dynamically set the four detection regions respectively corresponding to the four registers 161, 162, 163, and 164 by using a result of a previous still image detection operation, and may divide the input image data IDAT for the display panel 110 into the four detection region image data DRDAT1, DRDAT2, DRDAT3, and DRDAT4 for the four detection regions.

The four linear feedback shift registers 172*a*, 173*a*, 174*a*, and 175*a* may calculate the four current representative values, or the four current checksum values CCSV1, CCSV2, CCSV3, and CCSV4 of the four detection region image data DRDAT1, DRDAT2, DRDAT3, and DRDAT4. As illustrated in FIG. 3, each four linear feedback shift register 200 of the four linear feedback shift registers 172*a*, 173*a*, 174*a*, and 175*a* may include K flip-flops (FFs) 211, 212, 213, . . . , 214 and K XOR gates 221, 222, 223, . . . , 224, where K is an integer greater than 1. The K flip-flops 211, 212, 213, . . . , 214 may store an initial value, or a seed, the K XOR gates 221, 222, 223, . . . , 224 may perform an XOR operation on the seed and K bits of detection region image data DRDAT (e.g., DRDAT1, DRDAT2, DRDAT3, or DRDAT4), and the K flip-flops 211, 212, 213, . . . , 214 may shift a result of the XOR operation by predetermined bits. Then, the next XOR operation may be performed on a current value of the K flip-flops 211, 212, 213, . . . , 214 and the next K bits of the detection region image data DRDAT, and a result of the next XOR operation may be shifted by the predetermined bits. These XOR and shift operations may be repeated until the XOR and shift operations are performed for all bits of the detection region image data DRDAT, which results in a current checksum value (e.g., CCSV1) of the detection region image data DRDAT. Although FIG. 3 illustrates an example of each four linear feedback shift register 200 including the K flip-flops 211, 212, 213, . . . , 214 and the K XOR gates 221, 222, 223, . . . , 224, a configuration of the four linear feedback shift register 200 is not limited to the example of FIG. 3.

The representative value comparing block 176 may determine whether each of the four detection regions is the still image region or the moving image region by respectively comparing the four current checksum values CCSV1, CCSV2, CCSV3, and CCSV4 with the four previous checksum values PCSV1, PCSV2, PCSV3, and PCSV4. For example, the representative value comparing block 176 may determine that a detection region is the still image region in a case where a current checksum value (e.g., CCSV1) for the detection region is substantially the same as a previous checksum value (e.g., PCSV1) for the detection region, and may determine that the detection region is the moving image region in a case where the current checksum value (e.g., CCSV1) for the detection region is different from the previous checksum value (e.g., PCSV1) for the detection region. Further, the representative value comparing block 176 may store the four current checksum values CCSV1, CCSV2, CCSV3, and CCSV4 in the four registers 161, 162, 163, and 164 such that the four current checksum values CCSV1, CCSV2, CCSV3, and CCSV4 are used as the four previous checksum values PCSV1, PCSV2, PCSV3, and PCSV4 in the next frame period.

In exemplary embodiments of the inventive concept, as illustrated in FIG. 4, for a controller 150*b*, the four previous representative values may be four previous average values PAVGV1, PAVGV2, PAVGV3, and PAVGV4, and the four current representative values may be four current average values CAVGV1, CAVGV2, CAVGV3, and CAVGV4. For example, to perform the still image detection operation by comparing the four current average values CAVGV1, CAVGV2, CAVGV3, and CAVGV4 with the four previous average values PAVGV1, PAVGV2, PAVGV3, and PAVGV4, as illustrated in FIG. 4, a still image detection block 170*b* of the controller 150*b* may include the detection region setting block 171, N (e.g., four) average calculators 172*b*, 173*b*, 174*b*, and 175*b*, and the representative value comparing block 176. Each average calculator (e.g., 172*b*) may calculate a corresponding current average value (e.g., CAVGV1) by averaging gray levels represented by corresponding detection region image data (e.g., DRDAT1). The representative value comparing block 176 may determine whether each of the four detection regions is the still image region or the moving image region by comparing the four current average values CAVGV1, CAVGV2, CAVGV3, and CAVGV4 with the four previous average values PAVGV1, PAVGV2, PAVGV3, and PAVGV4, respectively.

In exemplary embodiments of the inventive concept, as illustrated in FIG. 5, for a controller 150*c*, the four previous representative values may be four previous sum values PSUMV1, PSUMV2, PSUMV3, and PSUMV4, and the four current representative values may be four current sum values CSUMV1, CSUMV2, CSUMV3, and CSUMV4. For example, to perform the still image detection operation by comparing the four current sum values CSUMV1, CSUMV2, CSUMV3, and CSUMV4 with the four previous sum values PSUMV1, PSUMV2, PSUMV3, and PSUMV4, as illustrated in FIG. 5, a still image detection block 170*c* of the controller 150*c* may include the detection region setting block 171, N (e.g., four) sum calculators 172*c*, 173*c*, 174*c*, and 175*c*, and the representative value comparing block 176. Each sum calculator (e.g., 172*c*) may calculate a corresponding current sum value (e.g., CSUMV1) by summing gray levels represented by corresponding detection region image data (e.g., DRDAT1). The representative value comparing block 176 may determine whether each of the four detection regions is the still image region or the moving image region by comparing the four current sum values CSUMV1, CSUMV2, CSUMV3, and CSUMV4 with the four previous sum values PSUMV1, PSUMV2, PSUMV3, and PSUMV4, respectively.

Referring to FIGS. 1, 2, and 6, in exemplary embodiments of the inventive concept, the still image detection block 170*a* may efficiently perform the still image detection operation by dynamically changing the four detection regions respectively corresponding to the four registers 161, 162, 163, and 164.

For example, in first and second frame periods FP1 and FP2, the still image detection block 170*a* may divide the display panel 110*a* into four first detection regions DR1*a*, DR2*a*, DR3*a*, and DR4*a*, and may perform a first still image detection operation for each of the first detection regions DR1*a*, DR2*a*, DR3*a*, and DR4*a* by using the four registers 161, 162, 163, and 164.

As an example, in the first and second frame periods FP1 and FP2, the detection region setting block 171 may equally divide the display panel 110*a* into the four first detection regions DR1*a*, DR2*a*, DR3*a*, and DR4*a* along a column direction (e.g., a direction of a data line), and may equally divide the input image data IDAT for the display panel 110*a* into four first detection region image data DRDAT1, DRDAT2, DRDAT3, and DRDAT4 for the four first detection regions DR1*a*, DR2*a*, DR3*a*, and DR4*a* having substantially the same size. The four registers 161, 162, 163, and 164 may store the previous representative values (e.g., PCSV1, PCSV2, PCSV3, and PCSV4) of the first detection region image data DRDAT1, DRDAT2, DRDAT3, and DRDAT4 in the first frame period FP1. In the second frame period FP2, the still image detection block 170*a* may calculate the current representative values (e.g., CCSV1, CCSV2, CCSV3, and CCSV4) of the first detection region image data DRDAT1, DRDAT2, DRDAT3, and DRDAT4, and may perform the first still image detection operation that determines whether each of the first detection regions DR1*a*, DR2*a*, DR3*a*, and DR4*a* is the still image region or the moving image region by comparing the current representative values (e.g., CCSV1, CCSV2, CCSV3, and CCSV4) with the previous representative values (e.g., PCSV1, PCSV2, PCSV3, and PCSV4) stored in the four registers 161, 162, 163, and 164.

In third and fourth frame periods FP3 and FP4, the still image detection block 170*a* may divide the display panel 110*b* into four second detection regions DR1*b*, DR2*b*, DR3*b*, and DR4*b* different from the first detection regions DR1*a*, DR2*a*, DR3*a*, and DR4*a* by using a result of the first still image detection operation, and may perform a second still image detection operation on each of the second detection regions DR1*b*, DR2*b*, DR3*b*, and DR4*b* by using the four registers 161, 162, 163, and 164.

As an example, in the third and fourth frame periods FP3 and FP4, the detection region setting block 171 may set a still image region DR3*a* and DR4*a* detected by the first still image detection operation as one detection region DR4*b* of the second detection regions DR1*b*, DR2*b*, DR3*b*, and DR4*b*, may set remaining three detection regions DR1*b*, DR2*b*, and DR3*b* of the second detection regions DR1*b*, DR2*b*, DR3*b*, and DR4*b* having substantially the same size by equally dividing a moving image region DR1*a* and DR2*a* detected by the first still image detection operation, and may divide the input image data IDAT for the display panel 110*b* into four second detection region image data DRDAT1, DRDAT2, DRDAT3, and DRDAT4 for the second detection regions DR1*b*, DR2*b*, DR3*b*, and DR4*b*. In other words, at least two of the first detection regions (e.g., DR3*a* and DR4*a*) may be set as one detection region (e.g., DR4*b*) of the second detection regions. A remaining portion (e.g., DR1*a* and DR2*a*) of the first detection regions may be equally divided into N−1 detection regions (e.g., DR1*b*, DR2*b*, and DR3*b*) of the second detection regions. The four registers 161, 162, 163, and 164 may store the previous representative values (e.g., PCSV1, PCSV2, PCSV3, and PCSV4) of the second detection region image data DRDAT1, DRDAT2, DRDAT3, and DRDAT4 in the third frame period FP3. In the fourth frame period FP4, the still image detection block 170*a* may calculate the current representative values (e.g., CCSV1, CCSV2, CCSV3, and CCSV4) of the second detection region image data DRDAT1, DRDAT2, DRDAT3, and DRDAT4, and may perform the second still image detection operation that determines whether each of the second detection regions DR1*b*, DR2*b*, DR3*b*, and DR4*b* is the still image region or the moving image region by comparing the current representative values (e.g., CCSV1, CCSV2, CCSV3, and CCSV4) with the previous representative values (e.g., PCSV1, PCSV2, PCSV3, and PCSV4) stored in the four registers 161, 162, 163, and 164.

Changing the detection regions such that one detection region is assigned to the still image region detected by a previous still image detection operation may be performed and repeated until the still image region detected by a current still image detection operation is substantially the same as the still image region detected by the previous still image detection operation.

For example, in a case where the still image region (e.g., DR3*a* and DR4*a*, or DR4*b*) detected by the previous still image detection operation (e.g., the first still image detection operation) and the still image region (e.g., DR3*b* and DR4*b*) detected by the current still image detection operation (e.g., the second still image detection operation) are different from each other, in fifth and sixth frame periods FP5 and FP6 subsequent to the third and fourth frame periods FP3 and FP4, the detection region setting block 171 may set the still image region DR3*b* and DR4*b* detected by the second still image detection operation as one detection region DR4*c* of four third detection regions DR1*c*, DR2*c*, DR3*c*, and DR4*c* of the display panel 110*c*, and may set remaining three detection regions DR1*c*, DR2*c*, and DR3*c* of the third detection regions DR1*c*, DR2*c*, DR3*c*, and DR4*c* having substantially the same size by equally dividing a moving image region DR1*b* and DR2*b* detected by the second still image detection operation. In the fifth and sixth frame periods FP5 and FP6, the still image detection block 170*a* may perform a third still image detection operation on each of the third detection regions DR1*c*, DR2*c*, DR3*c*, and DR4*c* by using the four registers 161, 162, 163, and 164.

In a case where the still image region (e.g., DR3*b* and DR4*b*, or DR4*c*) detected by the previous still image detection operation (e.g., the second still image detection operation) and the still image region (e.g., DR4*c*) detected by the current still image detection operation (e.g., the third still image detection operation) are substantially the same as each other, the still image detection block 170*a* may gradually increase the detection region assigned to the still image region per two frame periods. For example, in seventh and eighth frame periods FP7 and FP8 subsequent to the fifth and sixth frame periods FP5 and FP6, the detection region setting block 171 may increase the still image region (e.g., DR4*c*) detected by the third still image detection by M pixels in the column direction (e.g., the direction of the data line), where M is an integer greater than 0, may set the still image region increased by the M pixels as one detection region DR4*d* of four fourth detection regions DR1*d*, DR2*d*, DR3*d*, and DR4*d* of the display panel 110*d*, may decrease a moving image region (e.g., DR1*c*, DR2*c*, and DR3*c*) detected by the third still image detection operation by the M pixels in the column direction, and may set remaining three detection regions DR1*d*, DR2*d*, and DR3*d* of the fourth detection regions DR1*d*, DR2*d*, DR3*d*, and DR4*d* having substantially the same size by equally dividing the moving image region decreased by the M pixels. In the seventh and eighth frame periods FP7 and FP8, the still image detection block 170*a* may perform a fourth still image detection operation on each of the fourth detection regions DR1*d*, DR2*d*, DR3*d*, and DR4*d* by using the four registers 161, 162, 163, and 164.

Gradually increasing the detection region assigned to the still image region may be repeated until all the detection regions are determined as the moving image region. For example, in a case where the still image region is detected by the fourth still image detection operation, the detection region setting block 171 may further increase the still image region detected by the fourth still image detection operation by the M pixels in the column direction, may set the still image region further increased by the M pixels as one of four fifth detection regions, may further decrease the moving image region detected by the fourth still image detection operation by the M pixels in the column direction, and may set the remaining three of the fifth detection regions having substantially the same size by equally dividing the moving image region further decreased by the M pixels. The still image detection block 170*a* may perform a fifth still image detection operation on each of the fifth detection regions by using the four registers 161, 162, 163, and 164.

In a case where all of the detection regions (e.g., the fifth detection regions) are determined as the moving image region by the current still image detection operation (e.g., the fifth still image detection operation), the still image detection block 170*a* may perform subsequent still image detection operations by using the detection regions (e.g., the fourth detection regions DR1*d*, DR2*d*, DR3*d*, and DR4*d*) used in the previous still image detection operation (e.g., the fourth still image detection operation). For example, in a case where all of the fifth detection regions are determined as the moving image region by the fifth still image detection operation, in subsequent frame periods, the detection region setting block 171 may set the fourth detection regions DR1*d*, DR2*d*, DR3*d*, and DR4*d* used in the fourth still image detection operation, and may continuously perform subsequent still image detection operations on the fourth detection regions DR1*d*, DR2*d*, DR3*d*, and DR4*d* by using the four registers 161, 162, 163, and 164. Further, the still image detection block 170*a* may continuously use the fourth detection regions DR1*d*, DR2*d*, DR3*d*, and DR4*d* until the still image region (e.g., DR4*d*) detected by a subsequent still image detection operation is changed. If the still image region (DR4*d*) detected by the subsequent still image detection operation is changed, the still image detection block 170*a* may reset the fourth detection regions DR1*d*, DR2*d*, DR3*d*, and DR4*d*, and may again use the first detection regions DR1*a*, DR2*a*, DR3*a*, and DR4*a* into which the display panel 110*a* is equally divided.

In this manner, by dynamically setting or changing the detection regions respectively corresponding to the N registers 160 by using the result of the previous still image detection operation, the panel driver 120 may not use the frame memory, and may minutely detect the still image region by using the limited number of registers 160.

Referring again to FIGS. 1 and 2, the driving frequency decision block 180 may determine a driving frequency of the moving image region detected by the still image detection block 170*a* as a normal driving frequency (e.g., about 120 Hz or about 60 Hz), and may determine a driving frequency of the still image region detected by the still image detection block 170*a* as a low frequency lower than the normal driving frequency by using the flicker lookup table 190.

The flicker lookup table 190 may store flicker values corresponding to respective gray levels (e.g., 256 gray levels from 0-gray level to 255-gray level). Here, the flicker value may represent a level of the flicker perceived by a user. For example, as illustrated in FIG. 7, the flicker lookup table 190 may store one flicker value per four gray levels, but the number of flicker values stored in the flicker lookup table 190 may not be limited to the example of FIG. 7. In an example, as illustrated in FIG. 7, the flicker lookup table 190 may store a flicker value of 0 corresponding to a driving frequency of about 1 Hz with respect to 0-gray level through 7-gray level, may store a flicker value of 40 corresponding to a driving frequency of about 2 Hz with respect to 8-gray level through 11-gray level, may store a flicker value of 80 corresponding to a driving frequency of about 5 Hz with respect to 12-gray level through 15-gray level, may store a flicker value of 120 corresponding to a driving frequency of about 10 Hz with respect to 16-gray level through 19-gray level, may store a flicker value of 160 corresponding to a driving frequency of about 30 Hz with respect to 20-gray level through 23-gray level, may store a flicker value of 200 corresponding to a driving frequency of about 60 Hz with respect to 24-gray level through 27-gray level, and may store a flicker value of 0 corresponding to a driving frequency of about 1 Hz with respect to 236-gray level through 255-gray level. However, the flicker values stored in the flicker lookup table 190 are not limited to the example of FIG. 7.

As illustrated in FIG. 8, in a case where the still image detection block 170*a* determines that three detection regions DR1 through DR3 of a display panel 110*e* are the moving image region and that one detection region DR4 of the display panel 110*e* is the still image region, the driving frequency decision block 180 may determine a first driving frequency FF1 of the moving image region as the normal driving frequency, for example, about 120 Hz. Further, the driving frequency decision block 180 may divide the still image region into a plurality of segments SEG1 through SEG20, may determine a plurality of segment flicker values corresponding to gray levels of image data for the plurality of segments SEG1 through SEG20 by using the flicker lookup table 190, and may determine a plurality of segment driving frequencies corresponding to the plurality of segment flicker values.

FIG. 8 illustrates an example where the segment driving frequencies of about 30 Hz, about 30 Hz, about 30 Hz, about 30 Hz, about 30 Hz, about 30 Hz, about 30 Hz, about 30 Hz, about 15 Hz, about 6 Hz, about 15 Hz, about 15 Hz, about 30 Hz, about 15 Hz, about 15 Hz, about 30 Hz, about 15 Hz, about 30 Hz, about 15 Hz, and about 30 Hz are determined with respect to first through twentieth segments SEG1 through SEG20. Further, the driving frequency decision block 180 may determine a second driving frequency FF2 of the still image region as the maximum frequency of the plurality of segment driving frequencies, for example about 30 Hz.

The panel driver 120 may drive the moving image region of the display panel 110 at the first driving frequency FF1, or the normal driving frequency, and may drive the still image region of the display panel at the second driving frequency FF2, or the low frequency lower than the normal driving frequency. For example, as illustrated in FIG. 9, in a case where the first driving frequency FF1 is about 120 Hz, and the second driving frequency FF2 is about 30 Hz, even if the controller 150 receives, as the input image data IDAT, frame data FDAT for the entire region of the display panel 110 in each frame period FP, the controller 150 may output, as the output image data ODAT, first partial data PD1 for the moving image region and second partial data PD2 for the still image region in one of four consecutive frame periods FP, but may output, as the output image data ODAT, only the first partial data PD1 for the moving image region in three of the four consecutive frame periods FP. Thus, the data driver 130 may provide the data signals DS to the moving image region in each frame period FP, but may provide the data signals DS to the still image region in only one of the four consecutive frame periods FP. Accordingly, the moving image region may be driven at the first driving frequency FF1 of about 120 Hz, and the still image region may be driven at the second driving frequency FF2 of about 30 Hz.

Figure 10:
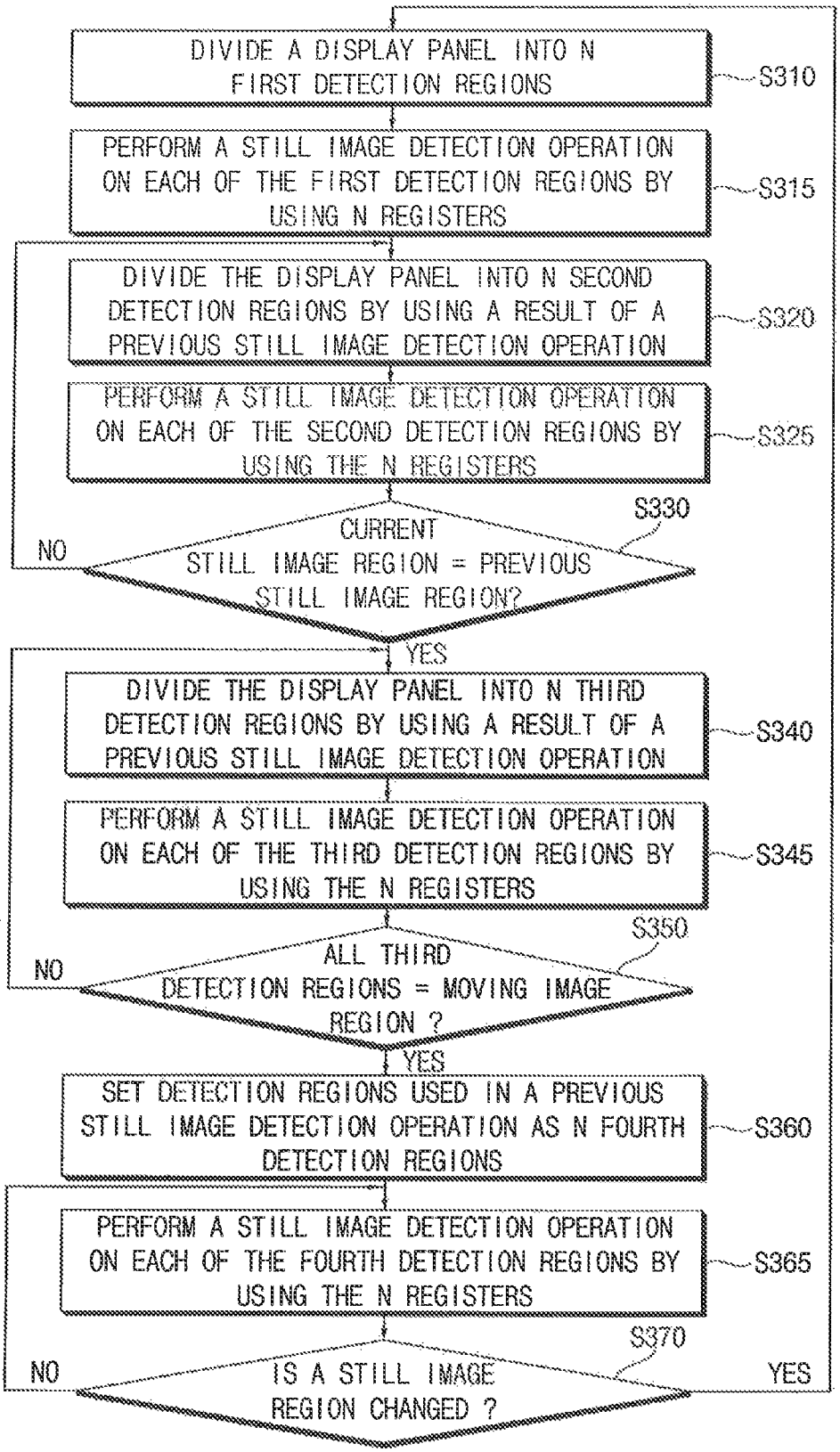
FIG. 10 is a flowchart illustrating a method of detecting a still image in a display device according to exemplary embodiments of the inventive concept.

FIG. 10 is a flowchart illustrating a method of detecting a still image in a display device according to exemplary embodiments of the inventive concept.

Referring to FIGS. 1 and 10, in a method of detecting a still image in the display device 100 including the N registers 160, the panel driver 120 may divide the display panel 110 into N first detection regions (S310). For example, in first and second frame periods, the panel driver 120 may equally divide the input image data IDAT for the display panel 110 into N first detection region image data for the first detection regions having substantially the same size.

The panel driver 120 may perform a first still image detection operation on each of the first detection regions by using the N registers 160 (S315). For example, in the first frame period, the panel driver 120 may calculate previous representative values for the first detection region image data, and may store the previous representative values in the N registers 160. Further, in the second frame period, the panel driver 120 may calculate current representative values for the first detection region image data, and may perform the first still image detection operation that determines whether each of the first detection regions is a still image region or a moving image region by comparing the current representative values with the previous representative values stored in the N registers 160.

The panel driver 120 may divide the display panel 110 into N second detection regions different from the first detection regions by using a result of the first still image detection operation (S320). For example, in third and fourth frame periods, the panel driver 120 may set a still image region detected by the first still image detection operation as one of the second detection regions, may set remaining N−1 detection regions of the second detection regions having substantially the same size by equally dividing a moving image region detected by the first still image detection operation, and may divide the input image data IDAT for the display panel 110 into N second detection region image data for the second detection regions.

The panel driver 120 may perform a second still image detection operation on each of the second detection regions by using the N registers 160 (S325). For example, in the third frame period, the panel driver 120 may calculate previous representative values for the second detection region image data, and may store the previous representative values in the N registers 160. Further, in the fourth frame period, the panel driver 120 may calculate current representative values for the second detection region image data, and may perform the second still image detection operation that determines whether each of the second detection regions is the still image regions or the moving image region by comparing the current representative values with the previous representative values stored in the N registers 160.

In a case where a previous still image region detected by a previous still image detection operation and a current still image region detected by a current still image detection operation are different from each other (S330: NO), the panel driver 120 may change the second detection regions by using a result of the current still image detection operation (S320), and may perform a still image detection operation on each of the changed second detection regions by using the N registers 160 (S325). For example, in a case where the still image region detected by the first still image detection operation and the still image region detected by the second still image detection operation are different from each other, the panel driver 120 may set the still image region detected by the second still image detection operation as one of N third detection regions, may set remaining N−1 detection regions of the third detection regions having substantially the same size by equally dividing a moving image region detected by the second still image detection operation, and may perform a third still image detection operation on each of the third detection regions by using the N registers 160.

Alternatively, in a case where the previous still image region detected by the previous still image detection operation and the current still image region detected by the current still image detection operation are substantially the same as each other (S330: YES), the panel driver 120 may set N third detection regions by increasing the current still image region detected by the current still image detection operation and by decreasing a current moving image region detected by the current still image detection operation (S340), and may perform a still image detection operation on each of the third detection regions by using the N registers 160 (S345).

For example, in a case where the still image region detected by the first still image detection operation and the still image region detected by the second still image detection operation are substantially the same as each other, the panel driver 120 may increase the still image region detected by the second still image detection by M pixels in a column direction, where M is an integer greater than 0, may set the still image region increased by the M pixels as one of N third detection regions, may decrease a moving image region detected by the second still image detection operation by the M pixels in the column direction, may set remaining N−1 detection regions of the third detection regions having substantially the same size by equally dividing the moving image region decreased by the M pixels, and may perform a third still image detection operation on each of the third detection regions by using the N registers 160.

In a case where the still image region is detected by the third still image detection operation (S350: NO), the panel driver 120 may further increase the still image region detected by the third still image detection operation by the M pixels in the column direction, may set the still image region further increased by the M pixels as one of N third detection regions, may further decrease the moving image region detected by the third still image detection operation by the M pixels in the column direction, may set remaining N−1 detection regions of the third detection regions having substantially the same size by equally dividing the moving image region further decreased by the M pixels, and may perform a still image detection operation on each of the third detection regions by using the N registers 160.

Alternatively, in a case where all of the third detection regions are determined as the moving image region (S350: YES), the panel driver 120 may set the detection regions used in the previous still image detection operation (e.g., the second detection regions used in the second still image detection operation) as N fourth detection regions (S360), and may perform a fourth still image detection operation on each of the fourth detection regions by using the N registers 160 (S365). Until the still image region detected by the fourth still image detection operation is changed (S370: NO), the fourth still image detection operation on each of the fourth detection regions may be continuously performed (S365). If the still image region detected by the fourth still image detection operation is changed (S370: YES), the fourth detection regions may be reset, and the method may be performed again from the initial operation (S310).

As described above, in the method of detecting the still image in the display device 100 according to exemplary embodiments of the inventive concept, the detection regions respectively corresponding to the N registers 160 may be dynamically set or changed by using the result of the previous still image detection operation. Accordingly, the panel driver 120 may not use a frame memory, and may minutely detect the still image region by using the limited number of registers 160.

Figure 11:
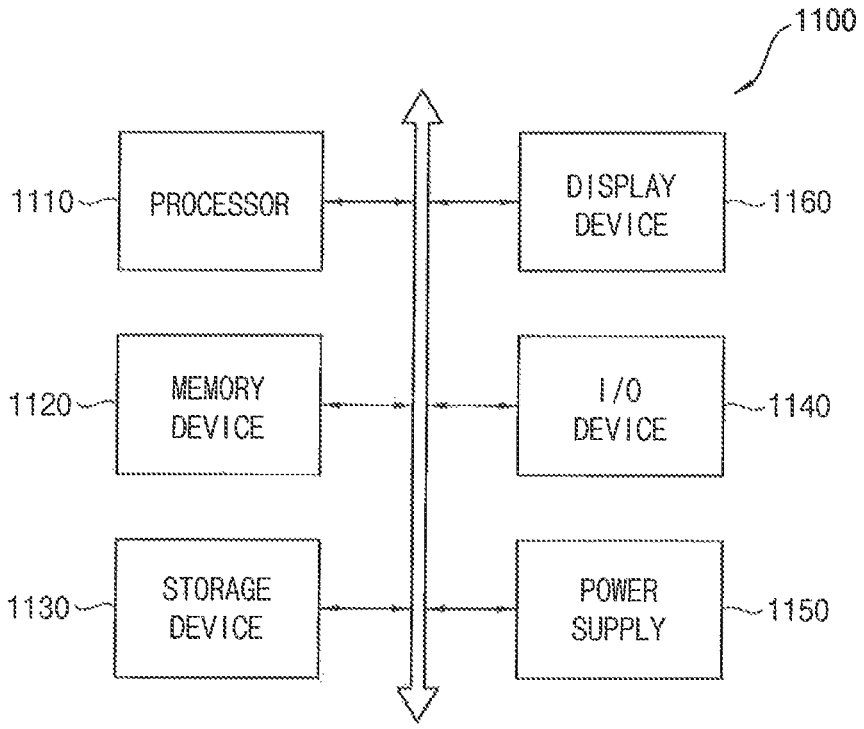
FIG. 11 is a block diagram illustrating an electronic device including a display device according to exemplary embodiments of the inventive concept.

FIG. 11 is a block diagram illustrating an electronic device including a display device according to exemplary embodiments of the inventive concept.

Referring to FIG. 11, an electronic device 1100 may include a processor 1110, a memory device 1120, a storage device 1130, an input/output (I/O) device 1140, a power supply 1150, and a display device 1160. The electronic device 1100 may further include a plurality of ports for communicating with a video card, a sound card, a memory card, a universal serial bus (USB) device, other electronic devices, etc.

The processor 1110 may perform various computing functions or tasks. The processor 1110 may be an application processor (AP), a microprocessor, a central processing unit (CPU), etc. The processor 1110 may be coupled to other components via an address bus, a control bus, a data bus, etc. Further, in exemplary embodiments of the inventive concept, the processor 1110 may be further coupled to an extended bus such as a peripheral component interconnect (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc., and an output device such as a printer, a speaker, etc. The power supply 1150 may supply power for operations of the electronic device 1100. The display device 1160 may be coupled to other components through the buses or other communication links.

The display device 1160 may divide a display panel into N first detection regions, may perform a first still image detection operation on each of the first detection regions by using N registers, may divide the display panel into N second detection regions different from the first detection regions by using a result of the first still image detection operation, and may perform a second still image detection operation on each of the second detection regions by using the N registers. Accordingly, the display device 1160 according to exemplary embodiments of the inventive concept may not use a frame memory, and may minutely detect a still image region by using the limited number of registers.

The inventive concept may be applied to any display device, and any electronic device including the display device. For example, the inventive concept may be applied to a mobile phone, a smart phone, a wearable electronic device, a tablet computer, a television (TV), a digital TV, a 3D TV, a personal computer (PC), a home appliance, a laptop computer, a personal digital assistant (PDA), a portable multimedia player (PMP), a digital camera, a music player, a portable game console, a navigation device, etc.

As described above, a display device and a method of detecting a still image in the display device according to exemplary embodiments of the inventive concept may divide a display panel into N first detection regions, may perform a first still image detection operation on each of the first detection regions by using N registers, may divide the display panel into N second detection regions different from the first detection regions by using a result of the first still image detection operation, and may perform a second still image detection operation on each of the second detection regions by using the N registers. Accordingly, the display device according to exemplary embodiments of the inventive concept may not use a frame memory, and may minutely detect a still image region by using the limited number of registers.

While the inventive concept has been shown and described with reference to exemplary embodiments thereof, it will be apparent to those of ordinary skill in the art that various changes in form and details may be made thereto without departing from the spirit and scope of the inventive concept as set forth by the appended claims.

What is claimed is:

1. A display device comprising:

a display panel including a plurality of pixels; and a panel driver including N registers, wherein N is an integer greater than 1, wherein the panel driver is configured to divide the display panel into N first detection regions, to perform a first still image detection operation on each of the N first detection regions by using the N registers, to divide the display panel into N second detection regions different from the N first detection regions by using a result of the first still image detection operation, and to perform a second still image detection operation on each of the N second detection regions by using the N registers, and wherein, in a first frame period, the panel driver calculates previous representative values for the N first detection region image data, and stores the previous representative values in the N registers.

2. The display device of claim 1, wherein, in the first frame period and a second frame period, the panel driver equally divides input image data for the display panel into N first detection region image data for the N first detection regions having a same size.

3. The display device of claim 2, wherein, in the second frame period, the panel driver calculates current representative values for the N first detection region image data, and performs the first still image detection operation that determines whether each of the N first detection regions is a still image region or a moving image region by comparing the current representative values with the previous representative values stored in the N registers.

4. The display device of claim 3, wherein each of the previous representative values and the current representative values is a checksum value of a corresponding one of the N first detection region image data.

5. The display device of claim 3, wherein each of the previous representative values and the current representative values is an average value of a corresponding one of the N first detection region image data.

6. The display device of claim 3, wherein each of the previous representative values and the current representative values is a sum value of a corresponding one of the N first detection region image data.

7. The display device of claim 1, wherein, in third and fourth frame periods, the panel driver sets a still image region detected by the first still image detection operation as one of the N second detection regions, sets remaining N−1 detection regions of the N second detection regions having a same size by equally dividing a moving image region detected by the first still image detection operation, and divides input image data for the display panel into N second detection region image data for the N second detection regions.

8. The display device of claim 7, wherein in the third frame period, the panel driver calculates previous representative values for the N second detection region image data, and stores the previous representative values in the N registers, and wherein, in the fourth frame period, the panel driver calculates current representative values for the N second detection region image data, and performs the second still image detection operation that determines whether each of the N second detection regions is the still image region or the moving image region by comparing the current representative values with the previous representative values stored in the N registers.

9. The display device of claim 1, wherein, in a case where a still image region detected by the first still image detection operation and a still image region detected by the second still image detection operation are different from each other, the panel driver sets the still image region detected by the second still image detection operation as one detection region of N third detection regions, sets remaining N−1 detection regions of the N third detection regions having a same size by equally dividing a moving image region detected by the second still image detection operation, and performs a third still image detection operation on each of the N third detection regions by using the N registers.

10. The display device of claim 1, wherein, in a case where a still image region detected by the first still image detection operation and a still image region detected by the second still image detection operation are substantially the same as each other, the panel driver increases the still image region detected by the second still image detection operation by M pixels in a first direction, where M is an integer greater than 0, sets the still image region detected by the second still image detection operation increased by the M pixels as one detection region of N third detection regions, decreases a moving image region detected by the second still image detection operation by the M pixels in the first direction, sets remaining N−1 detection regions of the N third detection regions having a same size by equally dividing the moving image region decreased by the M pixels, and performs a third still image detection operation on each of the N third detection regions by using the N registers.

11. The display device of claim 10, wherein, in a case where a still image region is detected by the third still image detection operation, the panel driver further increases the still image region detected by the third still image detection operation by the M pixels in the first direction, sets the still image region detected by the third still image detection operation further increased by the M pixels as one detection region of N fourth detection regions, further decreases a moving image region detected by the third still image detection operation by the M pixels in the first direction, sets remaining N−1 detection regions of the fourth detection regions having a same size by equally dividing the moving image region detected by the third still image detection operation further decreased by the M pixels, and performs a fourth still image detection operation on each of the N fourth detection regions by using the N registers.

12. The display device of claim 10, wherein, in a case where all of the N third detection regions are determined as a moving image region, the panel driver sets the N second detection regions used in the second still image detection operation as N fourth detection regions, and performs a fourth still image detection operation on each of the N fourth detection regions by using the N registers.

13. The display device of claim 12, wherein the panel driver continuously uses the N fourth detection regions until a still image region detected by the fourth still image detection operation is changed, and resets the N fourth detection regions when the still image region detected by the fourth still image detection operation is changed.

14. The display device of claim 12, wherein the panel driver drives a moving image region detected by the fourth still image detection at a first driving frequency, and drives a still image region detected by the fourth still image detection operation at a second driving frequency lower than the first driving frequency.

15. A method of detecting a still image in a display device including N registers, wherein N is an integer greater than 1, the method comprising:

dividing a display panel of the display device into N first detection regions;

calculating, in a first frame period, previous representative values for the N first detection region image data;

storing, in the first frame period, the previous representative values in the N registers;

performing a first still image detection operation on each of the N first detection regions by using the N registers;

dividing the display panel into N second detection regions different from the N first detection regions by using a result of the first still image detection operation; and performing a second still image detection operation on each of the N second detection regions by using the N registers.

16. The method of claim 15, wherein dividing the display panel into the first detection regions includes:

in the first frame period and a second frame period, equally dividing input image data for the display panel into N first detection region image data for the N first detection regions having a same size, and wherein performing the first still image detection operation includes:

in the second frame period, calculating current representative values for the N first detection region image data; and in the second frame period, performing the first still image detection operation that determines whether each of the N first detection regions is a still image region or a moving image region by comparing the current representative values with the previous representative values stored in the N registers.

17. The method of claim 15, wherein dividing the display panel into the N second detection regions includes:

in third and fourth frame periods, setting a still image region detected by the first still image detection operation as one of the N second detection regions;

in the third and fourth frame periods, setting remaining N−1 detection regions of the N second detection regions having a same size by equally dividing a moving image region detected by the first still image detection operation; and dividing input image data for the display panel into N second detection region image data for the N second detection regions, and wherein performing the second still image detection operation includes:

in the third frame period, calculating previous representative values for the N second detection region image data;

in the third frame period, storing the previous representative values in the N registers;

in the fourth frame period, calculating current representative values for the N second detection region image data; and in the fourth frame period, performing the second still image detection operation that determines whether each of the N second detection regions is the still image region or the moving image region by comparing the current representative values with the previous representative values stored in the N registers.

18. The method of claim 15, further comprising:

in a case where a still image region detected by the first still image detection operation and a still image region detected by the second still image detection operation are different from each other, setting the still image region detected by the second still image detection operation as one of N third detection regions;

setting remaining N−1 detection regions of the N third detection regions having a same size by equally dividing a moving image region detected by the second still image detection operation; and performing a third still image detection operation on each of the N third detection regions by using the N registers.

19. The method of claim 15, further comprising:

in a case where a still image region detected by the first still image detection operation and a still image region detected by the second still image detection operation are substantially the same as each other, increasing the still image region detected by the second still image detection by M pixels in a first direction, where M is an integer greater than 0;

setting the still image region detected by the second still image detection operation increased by the M pixels as one of N third detection regions;

decreasing a moving image region detected by the second still image detection operation by the M pixels in the first direction;

setting remaining N−1 detection regions of the N third detection regions having a same size by equally dividing the moving image region decreased by the M pixels; and performing a third still image detection operation on each of the N third detection regions by using the N registers.

20. A method of detecting a still image in a display device, the method comprising:

in first and second frame periods, equally dividing a display panel of the display device into N first detection regions, and equally dividing input image data into N first detection region image data, wherein N is an integer greater than 1;

in the first frame period, storing previous representative values of the N first detection region image data;

in the second frame period, calculating current representative values of the N first detection region image data, and performing a first still image detection operation to determine whether each of the N first detection regions is a still image region or a moving image region, by comparing the current representative values with the previous representative values;

in third and fourth frame periods, setting at least two of the N first detection regions as one detection region of N second detection regions, and equally dividing a remaining portion of the N first detection regions into remaining N−1 detection regions of the N second detection regions; and in the fourth frame period, performing a second still image detection operation to determine whether each of the N second detection regions is a still image region or a moving image region.

* * * * *